US005934535A

United States Patent [19]

Kannankeril et al.

[11] Patent Number: 5,934,535

[45] Date of Patent: Aug. 10, 1999

[54] BAG DISPENSING SYSTEM

[75] Inventors: Charles Paul Kannankeril, North Caldwell, N.J.; Bruce Arnold Cruikshank, Wilton, Conn.

[73] Assignee: Sealed Air Corporation, Saddle Brook, N.J.

[21] Appl. No.: 08/922,513

[22] Filed: Sep. 3, 1997

[51] Int. Cl.[6] ..... B26F 3/02

[52] U.S. Cl. ..... 225/106; 225/47

[58] Field of Search ..... 225/106, 42, 47, 225/46, 51, 52, 79, 82, 84; 242/598, 598.5, 599.3, 422.5

[56] References Cited

U.S. PATENT DOCUMENTS

| | | | |
|---|---|---|---|
| 352,950 | 11/1886 | Hicks | 242/598.5 |
| 2,008,297 | 7/1935 | Van Berkel | 242/422.5 |
| 2,147,351 | 2/1939 | Ram | 242/422.5 |
| 2,334,689 | 11/1943 | Wooster | 225/46 |
| 2,391,617 | 12/1945 | Crebbs | 225/106 |
| 2,661,165 | 12/1953 | Salmonson | 242/422.5 |
| 3,374,931 | 3/1968 | Abraham | 225/79 |
| 4,347,992 | 9/1982 | Imai | 242/598 |
| 5,054,675 | 10/1991 | Taves | 225/79 |
| 5,209,371 | 5/1993 | Daniels | 225/106 |
| 5,261,585 | 11/1993 | Simhaee . | |
| 5,344,225 | 9/1994 | Blyth | 312/34.4 |
| 5,480,084 | 1/1996 | Daniels | 225/106 |
| 5,556,019 | 9/1996 | Morris . | |
| 5,558,262 | 9/1996 | Simhaee | 225/106 |

FOREIGN PATENT DOCUMENTS

| | | |
|---|---|---|
| 0 730 080 A1 | 9/1996 | European Pat. Off. . |
| WO 91/13815 | 9/1991 | WIPO . |

*Primary Examiner*—Rinaldi I. Rada
*Assistant Examiner*—Gyounghyun Bae
*Attorney, Agent, or Firm*—Rupert B. Hurley, Jr.

[57] ABSTRACT

A bag dispensing system providing plastic bags from a roll of bags where one end is attached to the top of the next bag by perforation lines with a slot therebetween. The roll of bags provides a core having an indexing member on at least one end. The dispenser comprising a wire frame formed into channels to support the core. The channels include a core retaining member for restraining the core in the channel. The dispenser includes at least one brake attached to a support member and disposed at an angle thereto to provide tension to the edges of the roll of bags as the core passes through the channel passageway as bags are removed from the roll. Spaced apart from the support is a separating tongue. The tongue engages the slot regardless of whether the bags are drawn over or under the tongue.

24 Claims, 4 Drawing Sheets

BAG DISPENSING SYSTEM

BACKGROUND OF THE INVENTION

The present invention relates to a bag dispensing system. More specifically, the present invention relates to a system for dispensing plastic bags where each bag is separated from a roll of bags retained within the dispenser.

In supermarkets and other types of food markets, fruits, vegetables, and other produce are displayed in bulk, on tables or in open coolers. Plastic bags are provided for consumers who want them for their produce selections. These produce bags are most frequently dispensed from cylindrical rolls mounted horizontally or vertically. The top of each bag is attached to the bottom of the next bag. Each bag may be separated from the next bag along a perforated line that defines the end of one bag and the start of the next bag. By grabbing a bag with one hand and the next bag with the other hand, and then pulling, the consumer can separate the two bags along the perforation line. Sometimes consumers will tear or stretch the bags when trying to separate them or attempt to simply jerk the bag from the roll causing it to unravel. Additionally, after a bag has been taken from the roll, the next bag may lie flat on the surface of the roll, making it very difficult to find or peel from the roll. When a roll of bags is placed in an open dispenser the core on which the bags are rolled has a tendency, when bags are removed, to pop out of the guides retaining the roll in proper position within the dispenser.

Simhaee, in U.S. Pat. No. 5,261,585, discloses a plastic bag dispenser that attempts to overcome some of the problems inherent in existing dispensers by enabling the consumer to tear the bags with one hand without the bags unraveling by pulling the bags horizontally across a single finger and downwardly to separate the bags. This type of bag dispenser, however, does not include a tensioning member to prevent the rolls of bags from unraveling as the roll reaches a smaller diameter nor does it include means to retain the roll of bags within a guide channel.

An improved bag dispenser is shown in U.S. Pat. No. 5,556,019 to Morris, which discloses a wire frame bag dispenser having tensioning fingers along the core holding channels to retard the removal of bags from a roll. However, the tension provided by the fingers deters the core from easily descending through the channels as the roll gets smaller. In addition, it does not provide means to retain the roll of bags within a guide channel.

There remains a need for a bag dispenser that operates smoothly, is easy to use, can be easily mounted in various orientations, has a reliable brake for rolls as the diameter of the roll gets smaller, and is designed so that the rolls will not pop out of the channels when a bag is removed by, for example, jerking the bag.

SUMMARY OF THE INVENTION

The present invention is a bag dispensing system which includes a bag dispenser and a roll of bags on a core. The bag dispenser holds a series of bags where one bag is connected at its bottom end to the top of the next bag, but where a line of perforations and a slot facilitate separation of the bags. Additionally, the series of bags is rolled onto a core, preferably a tubular core, so that they may be supported and dispensed as the bags are unrolled. The perforations may be a row of small holes or short slits. The slot is a larger slit in the line of perforations. The perforations and slot define the end of one bag and the start of the next bag. The ends of the core extend past the outer edges of the roll of bags and at least one of the ends of the core has an indexing means.

The bag dispenser includes a support member for mounting the dispenser to a surface, a pair of guide channels, tensioning members, and a tongue for separating one bag from another. The support member is preferably a metal plate. The pair of guide channels are formed of a metallic wire and are designed to support the core so that it can rotate freely in place in the channels. Each of the guide channels has an open end for receiving the core and a closed end. Each channel is spaced from but attached to the support member by brackets.

The channels of the bag dispenser include core retaining outer bar members which form a part of each channel. The core retaining members help to maintain the core within the channels. The core retaining members are preferably attached to the outside of each channel at their closed ends and to the outside of the channel at their open ends. The guide channels have at least one core restraining member, preferably on the retaining member of the guide channel and located near the open end of the channel. In a preferred embodiment, the restraining member is a tab projecting inwardly to prevent the roll of bags from inadvertently being removed from the guide channels. In this embodiment the core indexing means is at least one slot in the core end adapted to be moved past the tab. Preferably the indexing means comprises a pair of slots, one of which may be off center from the other, i.e., not opposite the other. In another embodiment, the index means is formed by a slanted or angled core at one or both ends, which enables the roll of bags to enter the guide channels of a dispenser having a modified open end of the guide channel forming an angle to accommodate the core.

In a preferred embodiment, a tensioning member is positioned to apply tension to the circumference of the roll of bags as the bags are removed from the roll, preferably at the outer edges of the circumference. The tensioning member or brake is attached to the support member and positioned at an angle to the support member so as to contact the edges of the circumference of the roll thereby providing tension against the roll of bags to retard rotation of the roll. Therefore, the weight of the roll increases friction of the next bag being pulled between the roll and the brake.

The dispenser is provided with a tongue for separating the bags from each other. The tongue is spaced apart from and carried by the support member and is attached via a first support bracket which is in turn attached or possibly made integral to a second bracket which is, in turn, attached to the support member. The tongue is angled toward the series of bags and is designed to engage the slot between each bag to separate each bag from the next bag.

The tongue may be two-sided. By having a two-sided tongue, the slot in the perforation between bags will engage the tongue regardless of whether a bag is pulled across the top or the bottom of the tongue.

Other objects, features and advantages of the present invention will be apparent as the description proceeds when taken in conjunction with the accompanying drawings.

DETAILED DESCRIPTION OF A PREFERRED EMBODIMENT

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figures 1, 2, 3:
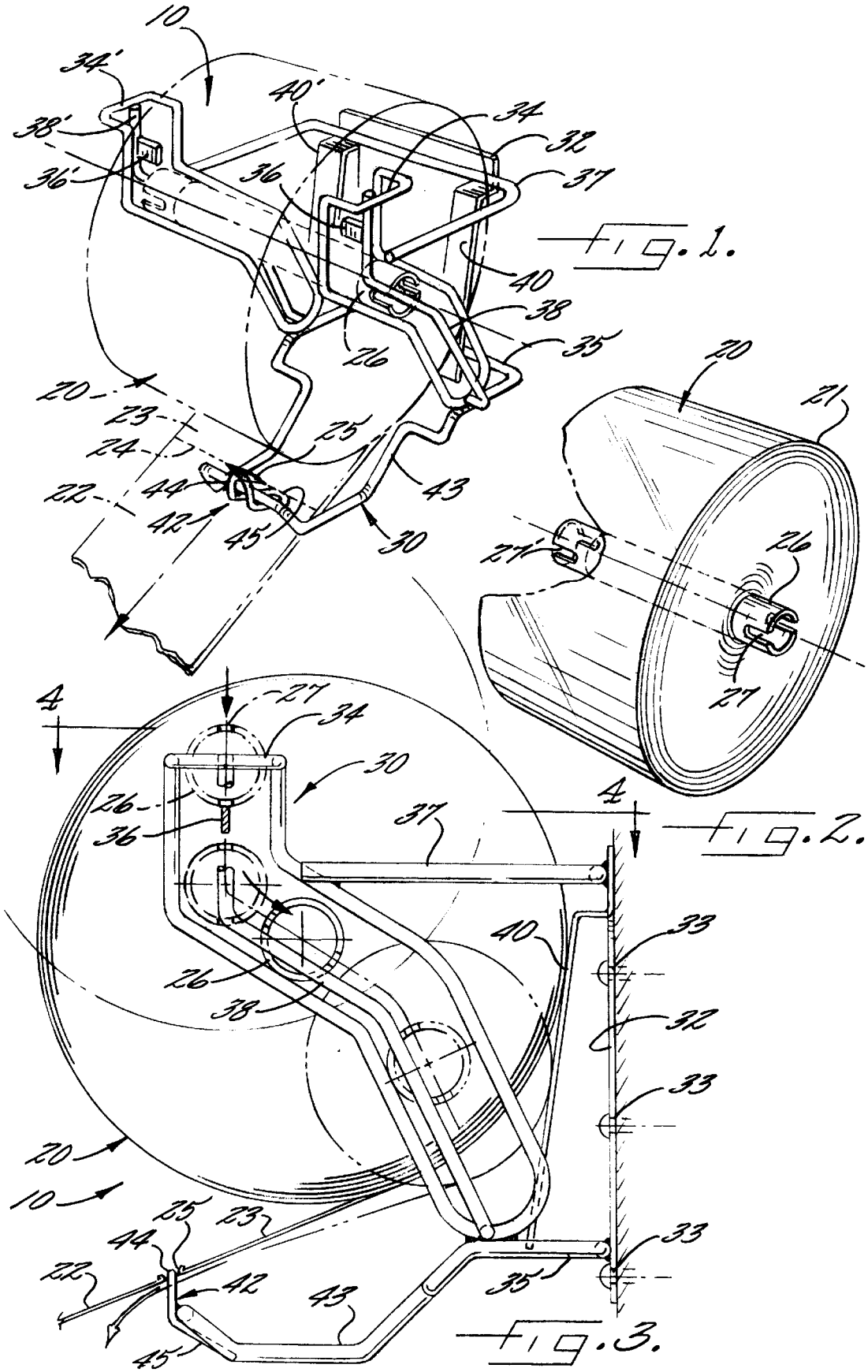
FIG. 1 is a perspective view of the bag dispensing system according to the present invention.
FIG. 2 is a partial cut-away view of a roll of bags arranged on the tubular core of the present invention.
FIG. 3 is a side view of the bag dispensing system according to the present invention.

Referring now more specifically to the drawings, there is shown in FIG. 1 the bag dispensing system 10 of the present invention. As illustrated, the bag dispensing system 10 includes a roll of plastic bags 20 rolled on a core having an indexing means and a dispenser 30 having a pair of guide channels.

The roll of plastic bags 20 includes the end of a first bag 22 connected to the top of a next bag 23 and separated by a perforated tear line 24 including a slot 25 located in a predetermined position within the perforated tear line 24, preferably at or near the midpoint between the sides of the bag. The bags are rolled onto a core 26 to form a roll having a circumference 21. The bag in the open position, i.e., when in use, may vary in width but is preferably about 12 inches. The bag is folded to a width of about 3 to about 4 inches when rolled onto the core 26. The slot 25 extends through each of the folds.

Bag dispenser 30 includes a support member 32, a pair of guide channels 34, 34' having at least one core restraining member 36, a tensioning member, brake 40, 40' and a tongue 42. Bag dispenser 30 includes a support member 32 for attachment to a support surface such as a wall or countertop. The support member 32 is a thin metal plate with a plurality of holes 33 suitable for attaching the bag dispenser 30 to a variety of surfaces.

A pair of channels 34, 34' are formed of wire frames. The channels 34, 34' are attached at their closed end to wire bracket 35 which is attached to support member 32. The channels 34, 34' are supported at their outer end by attachment to support bracket 37. In a preferred embodiment, the channels are formed of a wire or rod formed in a U-shaped frame extending outwardly and upwardly from wire bracket 35 as shown in FIG. 3. The distance of the channels 34, 34' from the brake 40, 40' is determined by the ever decreasing radius of the roll of bags being dispensed such that the outer circumference of the roll of bags remains in contact with the tensioning member. The sides of channels 34, 34' are dimensioned (spaced apart) to allow core 26 to rotate freely in place.

The core retaining members 38, 38' form a part of each guide channel. The channel retaining members 38, 38' are preferably wires attached to the outerside of each channel 34, 34' at the closed ends thereof and are formed so that they extend upwardly from the closed end of the channel between the outer edges thereof and attach to the open end of each channel. The open end of channels 34, 34' are shaped to easily receive a full roll of bags 20. As the roll of bags decreases in size, the core 26 passes through the channels 34, 34' toward the closed ends. The channel retaining members 38, 38' serve to keep the core within the channels and not pop out as the diameter of the roll of bags gets smaller. The channels 34, 34' and other frame members are constructed from metallic wire, such as stainless steel or chrome plated wire. These wires are aesthetically pleasing and also easy to clean, a requirement in the food industry.

Toward the top of channel retaining members 38, 38' are core restraining members 36, 36' for maintaining the core 26 within the channels 34, 34'. Although a single core retaining member may be used, it is preferable to use a core retaining member in each of the channels which member projects inwardly to prevent the roll of plastic bags from inadvertently being removed from the pair of channels. In the preferred embodiment shown in FIGS. 1 and 3, the core retaining members are inwardly projecting tabs 36, 36'.

Figure 4:
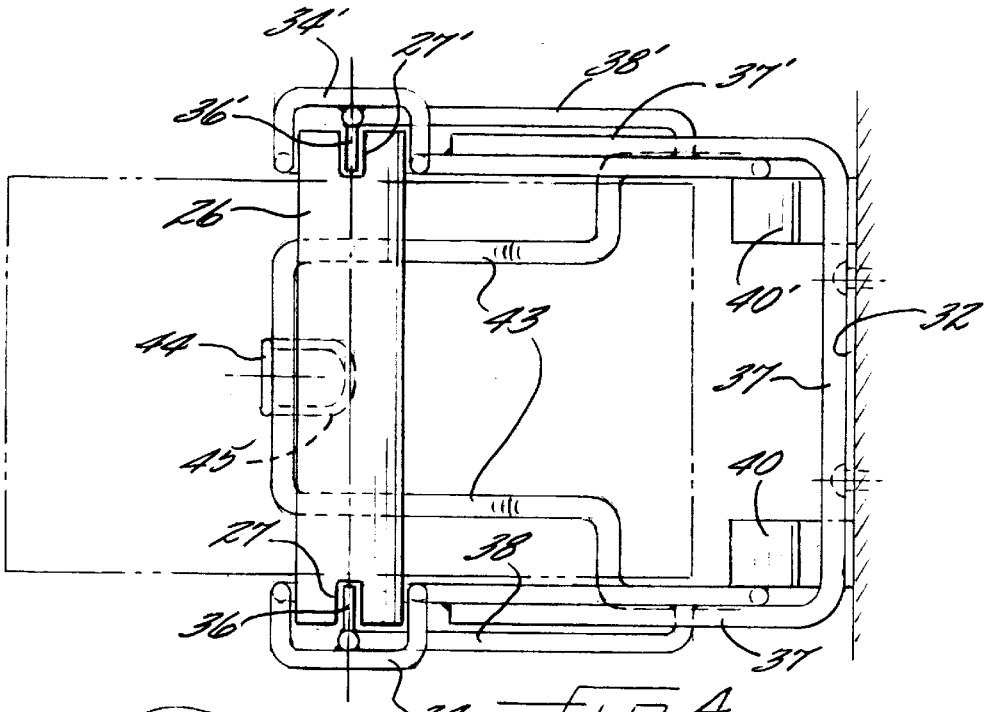
FIG. 4 is a top view of the bag dispenser with a full roll of bags in phantom taken along line 4—4 of FIG. 3.

In a preferred embodiment, tensioning member, brakes 40, 40' are attached to support member 32. As best seen in FIG. 3, brakes 40, 40' are attached to support member 32 so that they are positioned perpendicular to core 26. As shown most clearly in FIGS. 3 and 4, the brakes 40, 40' are two metal plates or bars, preferably disposed at an angle to support member 32 to provide tension against the circumference of the roll of bags as the bags are removed from the roll and the core passes through the channel passageway toward the closed end. The brakes 40, 40' are spaced apart such a distance that only the outer edges of the circumference of the roll of bags are in contact with each brake plate. By applying tension only at the edges of the roll any printing or indicia on the bags does not come in contact with the dispenser. Brakes 40, 40' support the weight of the roll of bags 20 so that as a bag is being dispensed, the weight of the roll of bags 20 against brakes 40, 40' acts to retard the dispensing of the roll of bags 20.

Brakes 40, 40' act to apply a tension to first bag 22 and next bag 23. When the roll of bags is full, the roll has enough weight to pinch bag 23 between roll of bags 20 and brakes 40, 40' so that a sufficient amount of tension is provided for tongue 42 to deflect. When the amount of bags in roll of bags 20 decreases, the amount of tension created by the weight of the roll of bags 20 decreases as well. Therefore, when there are fewer bags in roll of bags 20, the retardation provided by brakes 40, 40' act to maintain a level of tension sufficient for tongue 42 to deflect. Additionally, by retarding the rotation and dispensing of the roll of bags 20, brakes 40, 40' prohibit the roll of bags 20 from unraveling uncontrollably.

The dispenser 30 is provided with a tongue 42 spaced apart from and carried by the support member 32 in a predetermined position corresponding to the predetermined position of slot 25 in the tear line 24 separating the bags on roll 20. Tongue 42 may be constructed of metallic wire. The tongue 42 is attached to wire bracket 43, the ends of which are in turn attached to the outer sides of bracket 35. The wire of bracket 43 is preferably of such size that it deflects as a bag is removed from the roll. Bracket 43 extends downward away from bracket 35. Tongue 42 has a top 44 and a bottom 45 and is preferably a diamond shaped wire attached to bracket 43 at its midsection. (Best seen in FIGS. 3 and 4). Tongue 42 is dimensioned so that as first bag 22 is pulled across tongue 42, slot 25 engages it. Tongue 42 has top 44 and bottom 45 so that first bag 22 may be pulled either across top 44 of tongue 42 or across bottom 45 of tongue 42 and still have top 44 or bottom 45 engage slot 25, respectively. Tongue 42 is preferably bent inwardly from its attachment point, so that top 44 and bottom 45 each form an acute angle between bracket 43 and itself. Furthermore, to accommodate the variety of orientations for bag dispenser 30, bracket 43 may be angled differently to better allow slot 25 to engage tongue 42. Therefore, bag dispenser 30 may be mounted vertically, horizontally, or in another position by simply changing the angle of tongue 42, which may be done by interchanging tongue 42 with a different one or by bending tongue 42 to the desired angle.

Figure 7:
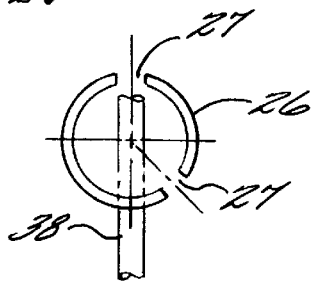
FIG. 7 is an end view of the tubular core showing another embodiment of the indexing member.

As shown in FIG. 2, the core 26 used to maintain the roll of bags 20 preferably has a slot 27 in at least one end, preferably in each end of the core as shown in FIG. 2. The ends of the core 27 extend outwardly from the sides of the roll of the bag in an amount sufficient to fit within the guide channels 34, 34'. In the embodiment shown in FIG. 7, the slots or notches 27, 27' in the ends of core 26 are disposed at an angle wherein they are not opposite each other.

Figure 5:
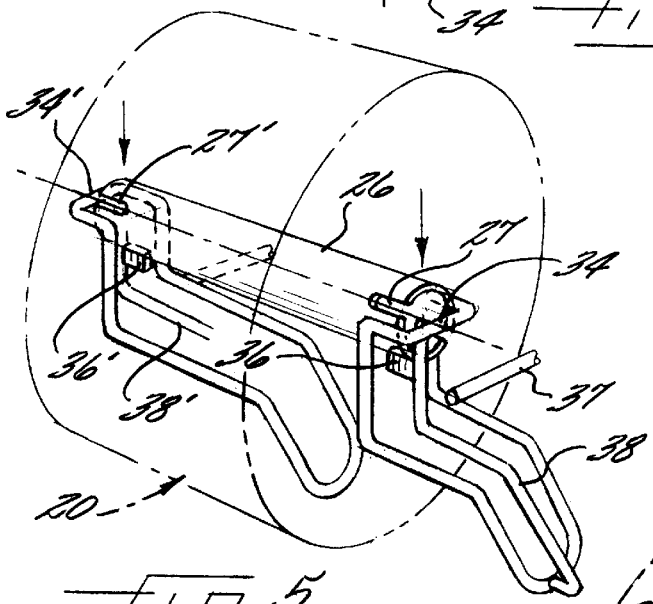
FIG. 5 is a partial perspective view showing the insertion of a roll of bags into the open end of the guide channels of a bag dispenser.
Figure 6:
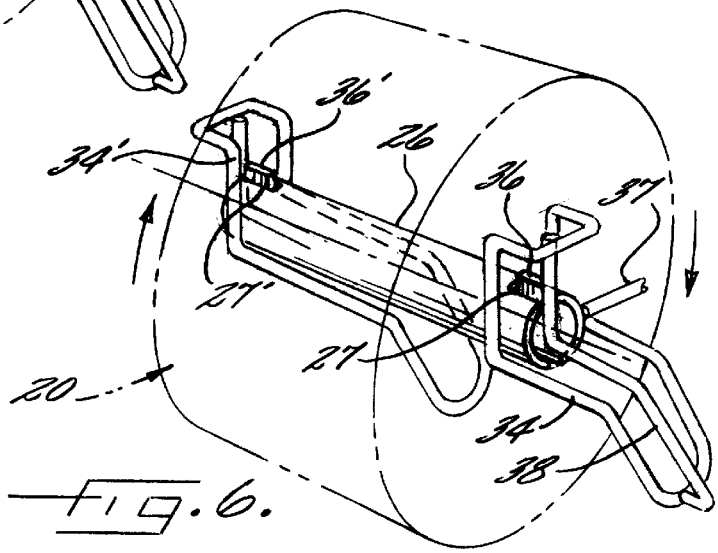
FIG. 6 is a partial perspective view showing alignment of a roll of bags having a tubular core into the guide channels of the dispenser.

In the embodiment shown in FIG. 5, a roll of bags 20 is placed in the open end of guide channels 34, 34' and rest on the upper side of tabs 36, 36' in such manner that the indexing means 27, 27' are disposed away from the tabs. As shown in FIG. 6, the roll of bags 20 is rotated so that the tabs 36, 36' extend through the indexing means 27, 27'. As shown in FIG. 6 wherein the indexing means 27, 27' are disposed in core 26 opposite each other, the roll of bags 20 drops directly into main portion of channels 34, 34' and is retained by channel retaining members 38, 38'.

Figure 9A:
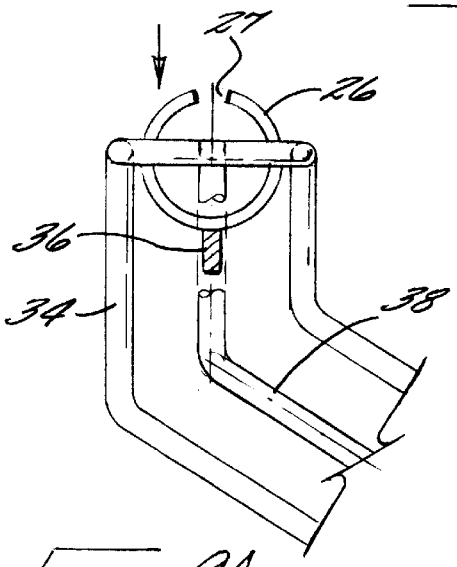
FIG. 9A is a partial side view showing the first step for placement of a tubular core into the upper portion of the open end of a guide channel of a bag dispenser of the present invention.
Figure 9B:
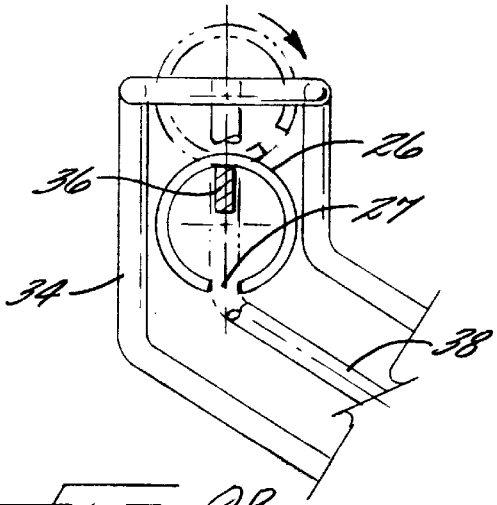
FIG. 9B is a partial side view showing rotation of the tubular core to align the slot with a restraining tab in a guide channel.
Figure 9C:
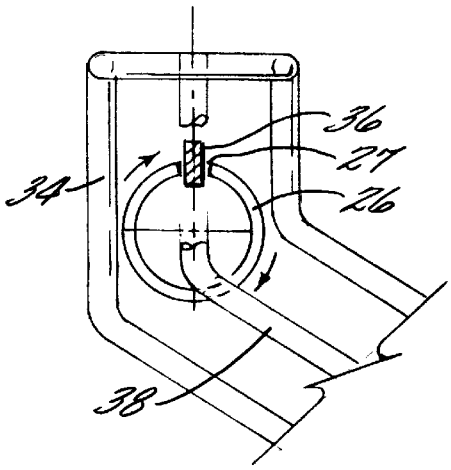
FIG. 9C is a partial side view showing rotation of the tubular core around the core restraining tabs to allow the core to move past the tabs.
Figure 9D:
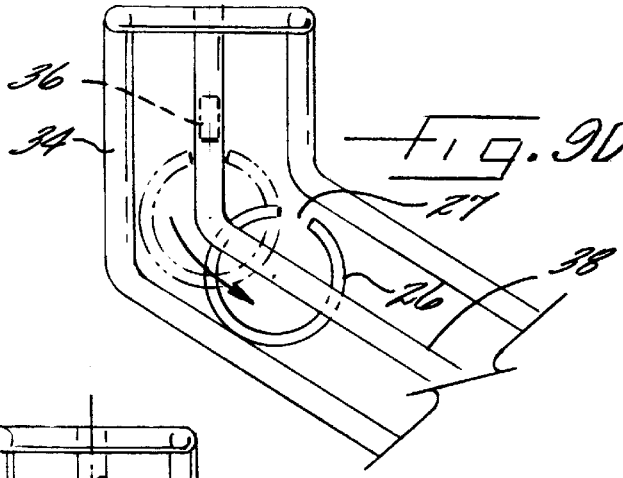
FIG. 9D is a partial side view showing movement of the tubular core downward through a guide channel.
Figure 9E:
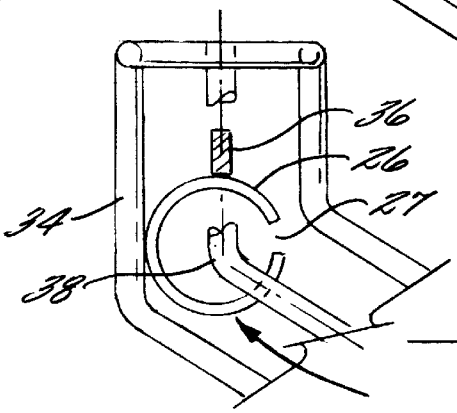
FIG. 9E is a partial side view showing the tab preventing movement of the tubular core upward through a guide channel.

In the embodiment shown in FIG. 9A, there is shown a single indexing member, slot 27 which rests on tab member 36. The core 27 is rotated as shown in FIG. 9B in which the indexing member 27 drops through the tab member 36 such that the tab is within the hollow portion of the core. The core 26 is again rotated as shown in FIG. 9C so that the slot 27 is disposed to tab 36 and the core 26 is allowed to pass downwardly through channel 34 as shown more clearly in FIG. 9D. As shown in FIG. 9E, restraining tab 36 prevents the core 26 from inadvertently being removed from the channel guide 34.

Figure 8:
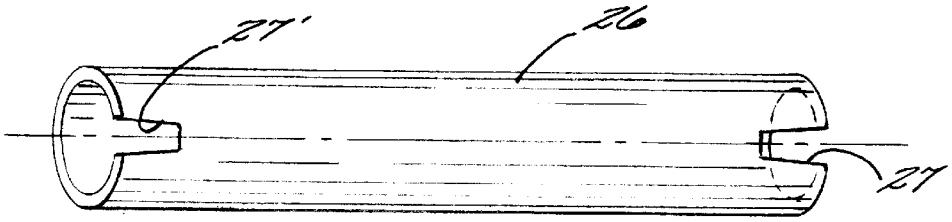
FIG. 8 is a perspective view illustrating a tubular core having tapered and slotted ends for use in the present invention.

In FIG. 8 there is shown another embodiment of core 26 in which there is shown a single indexing member at each end of the core 26 slots 27, 27'. In addition, the core of this embodiment has tapered ends to more easily fit within the channels.

Figure 10:
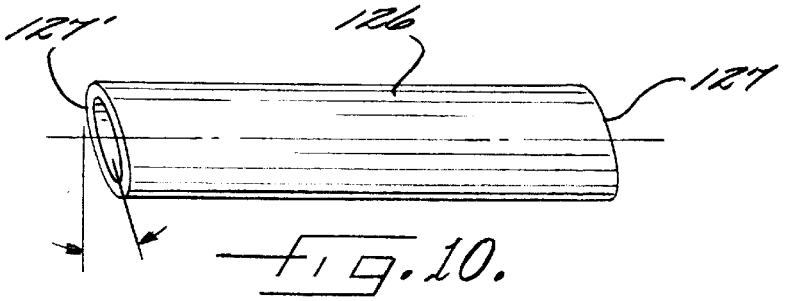
FIG. 10 is a perspective view illustrating a tubular core for use in the present invention having slanted ends in the same direction.
Figure 11:
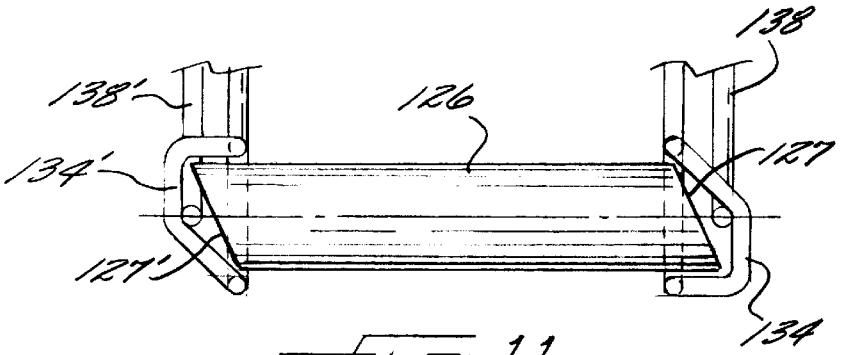
FIG. 11 is a partial top view illustrating insertion of the tubular core of FIG. 10 into the open ends of the guide channels of a bag dispenser.

In FIG. 10, there is shown yet another embodiment of the present invention in which a tubular core 126 has slanted ends 127, 127' in the same direction. When using a core having this embodiment, the indexing member is provided by forming the wire members at the open end of each guide channel 127, 127' to conform to the angle of the core ends, providing the directional turning of the core member as shown more clearly in FIG. 11.

Figure 12:
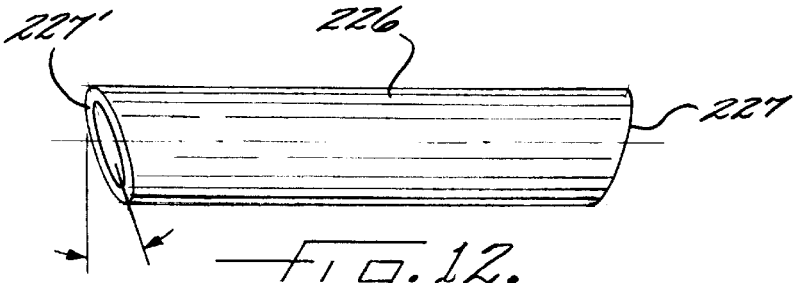
FIG. 12 is a perspective view of another embodiment illustrating a tubular core for use in the present invention having ends slanted in opposite directions.
Figure 13:
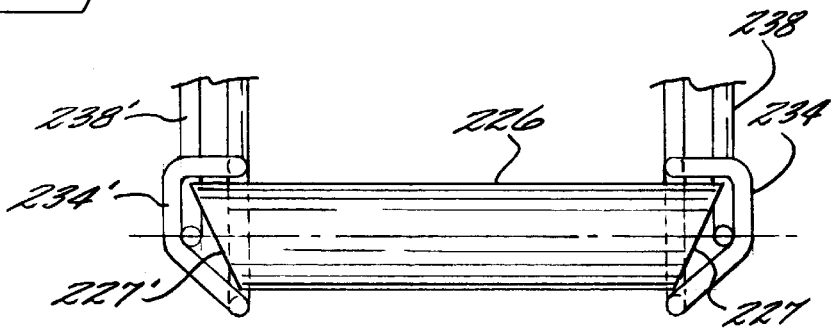
FIG. 13 is a partial top view illustrating insertion of the tubular core of FIG. 12 into the open ends of the guide channels of a bag dispenser.

FIG. 12 shows yet another embodiment of tubular core 226 in which the slanted ends 227, 227' are provided in the same direction. In this embodiment, the indexing member is provided by forming the wire members at the open ends of the guide channels 227, 227' to conform to be slanted in the same direction as shown most clearly in FIG. 13.

In operation, a user takes first bag 22 in hand and pulls it either over or under tongue 42 creating a tension in first bag 22 and next bag 23. The tension created in the bags causes the tongue 42 and bracket 43 to deflect up or down depending on the orientation of the bags. See FIG. 3. The user continues to pull first bag 22 until tongue 42 snaps into slot 25, thus stopping next bag 23 and facilitating the tearing of first bag 22 along perforation line 24 as tongue 42 recoils from its deflected position to its normal position. The addition of the recoil force applied by tongue 42 helps to separate the two bags and decreases the amount of force the user must apply. Additionally, the application of the recoil force from tongue 42 on next bag 23 will lift the next bag so that it will be easy to grab by the next user.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A bag dispensing system comprising:

a roll of plastic bags rolled onto a core, the individual bags of said roll being separated by a perforated tear line including a slot located in a predetermined position within said tear line said core having a pair of ends extending past the edges of said roll of bags and having an indexing means on at least one end of said core; and a dispenser comprising:

a support member for attachment to a support surface;

a pair of guide channels carried by said support member for rotatably supporting said roll of plastic bags for rotation of the roll on said core, each of said guide channels having an open end for receiving said core and a closed end;

said pair of channels further comprising channel retaining members for maintaining said core within said channels, at least one of said channel retaining members having a core restraining member to prevent said roll of plastic bags from inadvertently being removed from said pair of channels; and a tongue spaced apart from and carried by said support member in a predetermined position corresponding to the predetermined position of said slot in said tear line.

2. The bag dispensing system according to claim 1 further comprising a brake attached to said support member and disposed at an angle thereto to provide tension against the circumference of said roll of bags and retard rotation of said roll.

3. The bag dispensing system according to claim 1 wherein said brake further comprises a pair of narrow brake plates disposed near the edges of the circumference of said roll of plastic bags.

4. The bag dispensing system according to claim 1 wherein said indexing means comprises at least one slot in the end of said core.

5. The bag dispensing system according to claim 1 wherein said core is a tubular core and said indexing means comprises a pair of slots in at least one end of said core.

6. The bag dispensing system according to claim 5 wherein said slots are not opposite each other.

7. The bag dispensing system according to claim 1 wherein said core restraining member is a tab.

8. The bag dispensing system according to claim 7 wherein said tab is located at a distance below the top of the guide channels so that the roll of bags may rest before fully entering the channel by clearing said tab.

9. The bag dispensing system according to claim 1 wherein said indexing means comprises slanting at least on end of said core.

10. The bag dispensing system according to claim 1 wherein said tongue having a top engaging portion and a bottom engaging portion, one of said portions engages said slot in said tear line regardless of whether said bags are brought over said top of said tongue or over said bottom of said tongue.

11. The bag dispensing system according to claim 1 wherein said tongue support member is acutely angled toward said roll of bags.

12. A bag dispensing system comprising:

a roll of plastic bags rolled onto a tubular core, the individual bags of said roll being separated by a perforated tear line including a slot located in a predetermined position within said tear line said core having a pair of ends extending past the edges of said roll of bags, said core having an indexing means on at least one end of said core; and a dispenser comprising:

a support member for attachment to a support surface;

a pair of guide channels carried by said support member formed from metal rods for rotatably supporting said roll of plastic bags for rotation of the roll on said core and each of said guide channels having an open end for receiving said core and a closed end;

said pair of channels further comprising core retaining members for maintaining said core within said channels at least one of said core retaining members has a restraining member projecting inwardly to prevent said roll of plastic bags from inadvertently being removed from said pair of channels;

a pair of narrow brake plates attached to said support member and disposed at an angle thereto to provide tension against the circumference of said roll of bags and retard rotation of said roll;

a tongue spaced apart from and carried by said support member in a predetermined position corresponding to the predetermined position of the slot in said tear line, said tongue having a top and bottom to engage said slot in said tear line regardless of whether said bags are brought over said top of said tongue or over said bottom of said tongue, said tongue being acutely angled toward said roll of bags.

13. A dispenser for dispensing a roll of plastic bags rolled onto a core, the individual bags of said roll being separated by a perforated tear line including a slot located in a predetermined position within said tear line and said core having a pair of ends extending past the edges of said roll of bags and having an indexing means, said dispenser comprising:

a support member for attachment to a support surface;

a pair of guide channels carried by said support member for rotatably supporting said roll of plastic bags for rotation of the roll on said core and each of said guide channels having an open end for receiving said core and a closed end;

said pair of channels further comprising channel retaining members for maintaining said core within said channels, at least one of said channel retaining members having a core restraining member projecting inwardly to prevent said roll of plastic bags from inadvertently being removed from said pair of channels; and a tongue spaced apart from and carried by said support member in a predetermined position corresponding to the predetermined position of the slot in said tear line.

14. The dispenser according to claim 13 further comprising a pair of narrow brake plates attached to said support member and disposed at an angle thereto to provide tension against the circumference of said roll of bags.

15. The bag dispenser according to claim 13 wherein said core restraining member is a tab.

16. The bag dispenser according to claim 15 wherein said tab is located at a distance below the top of the guide channel for the roll of bags to rest before fully entering the channel by clearing the tab.

17. The bag dispenser according to claim 13 wherein said guide channel restraining member is a bent wire adapted to accommodate a slanted core.

18. The dispenser according to claim 17 wherein said tongue having a top engaging portion and a bottom engaging portion, one of said portions engages said slot in said tear line regardless of whether said bags are brought over said top of said tongue or over said bottom of said tongue.

19. A dispenser for dispensing a roll of plastic bags rolled onto a core, the individual bags of said roll being separated by a perforated tear line including a slot located in a predetermined position within said tear line and said core having an indexing means, said dispenser comprising:

a support member for attachment to a support surface;

a pair of guide channels carried by said support member formed from metal rods for rotatably supporting said roll of plastic bags for rotation of the roll on said core, each of said guide channels having an open end for receiving said core and a closed end;

said pair of channels further comprising channel retaining members for maintaining said core within said channels, at least one of said channel retaining members having a core restraining member projecting inwardly to prevent said roll of plastic bags from inadvertently being removed from said pair of channels;

a pair of narrow brake plates attached to said support member and disposed at an angle thereto to provide tension against the circumference of the said roll of bags; and a tongue spaced apart from and carried by said support member in a predetermined position corresponding to the predetermined position of the slot in said tear line, said tongue having a symmetrical diamond shaped top and bottom to engage said slot in said tear line regardless of whether said bags are brought over said top of said tongue or over said bottom of said tongue.

20. A roll of plastic bags rolled onto a core, the individual bags of said roll being separated by a perforated tear line, said core having a pair of ends extending past the edges of said roll of bags and having an indexing means comprising a slot on at least one end of said core.

21. The roll of bags according to claim 20 wherein said core is a tubular core and said indexing means comprises at least one slot in the end of said core.

22. The roll of bags according to claim 20 wherein said core is a tubular core and said indexing means comprises a pair of slots in at least one end of said core.

23. The roll of bags according to claim 22 wherein said slots are not opposite each other.

24. The roll of bags according to claim 20 wherein said indexing means comprises at least one slanted end of said core.

* * * * *